United States Patent [19]

Wakimoto et al.

[11] Patent Number: 4,857,106

[45] Date of Patent: Aug. 15, 1989

[54] METHOD FOR CONTROLLING OPERATION OF A BLAST FURNACE

[75] Inventors: Kazumasa Wakimoto; Motohiro Shibata; Takaharu Ishii; Masaaki Sakurai, all of Tokyo, Japan

[73] Assignee: Nippon Kokan Kabushiki Kaisha, Tokyo, Japan

[21] Appl. No.: 224,753

[22] Filed: Jul. 27, 1988

Related U.S. Application Data

[63] Continuation-in-part of Ser. No. 45,126, Apr. 30, 1987, abandoned.

[30] Foreign Application Priority Data

May 20, 1986 [JP] Japan ..... 61-113795

[51] Int. Cl.[4] ..... C21B 5/00

[52] U.S. Cl. ..... 75/41; 266/80; 266/44

[58] Field of Search ..... 75/41, 42; 266/44, 80

[56] References Cited

U.S. PATENT DOCUMENTS 4,227,921 10/1980 Matoba et al. ..... 75/41

FOREIGN PATENT DOCUMENTS 30007 8/1976 Japan .
64705 4/1984 Japan .

*Primary Examiner*—Melvyn J. Andrews
*Attorney, Agent, or Firm*—Frishauf, Holtz, Goodman & Woodward

[57] ABSTRACT

A method for controlling heat conditions in a blast furnace wherein the heat conditions are inferred and judged in comparison of data output from sensor means provided for the blast furnace with knowledge base means formed by accumulated experience on the operation of the blast furnace. The heat conditions are inferred and judged from levels of heat conditions and from levels of transition of heat conditions, wherein data regarding molten metal temperature and those regarding sensors are used. The inference and judgement are carried out by inference engine means included in a small-scale computer.

16 Claims, 9 Drawing Sheets

METHOD FOR CONTROLLING OPERATION OF A BLAST FURNACE

CROSS REFERENCE TO RELATED APPLICATION

This is a continuation-in-part-application of Ser. No. 45,126 filed on Apr. 30, 1987, now abandoned.

BACKGROUND OF THE INVENTION

1. Field of the Invention

The present invention relates to a method for controlling operation of a blast furnace, and more particularly, to a method for controlling heat conditions in the operation, based on information outputted from sensor means provided for the blast furnace.

2. Description of the Related Art

It is well-known, as a method for controlling temperature of molten metal tapped out of a blast furnace, by means of estimation of the temperature, to persons in the art, that operational factors are controlled to optimum, by means of evaluating furnace operation conditions, on the basis of qualitative judgement on information outputted from sensor means provided for the blast furnace.

Japanese Examined Patent Publication (KOKOKU) No. 30007/76, for example, describes a method for controlling blast furnace operation, wherein, in order to carry out optimum operation by means of amending a long cycle change appearing during computer control of blast furnace operation conditions, heat balance of the blast furnace operation is controlled by means of humidity of blast air blown in through tuyeres. The humidity is determined by an equation modified by an amendment member of preventing Si-content in molten metal from making a long cycle change. The amendment member is determined by an amount of direct reduction computed from measured values which are continuously obtainable during the blast furnace operation.

This method, however, is disadvantageous in that it requires an analysis model to be maintained by means of modification thereto in compliance with the changes the blast furnace undergoes through its life. In addition, the modification itself is quite a time-consuming and complicated task, as the analysis model is quite complex.

SUMMARY OF THE INVENTION

It is an object of the present invention to provide a method for controlling heat conditions in blast furnace operation, wherein an analysis model can easily be modified in compliance with the changes which the blast furnace undergoes during its life.

According to the present invention, a method is provided for controlling operation of a blast furnace, wherein the blast furnace includes a sensor means which outputs first data, corresponding to conditions in said blast furnace which comprises the steps of:

supplying a central processing unit with said first data outputted from said sensor means;

storing standard data corresponding to predetermined values of data corresponding to said conditions in said blast furnace;

preparing true-and-false data by comparing said firs data with said standard data;

storing information on operation and control characteristics of said blast furnace based on accumulated actual knowledge and experience of at least one operator of said blast furnace, said information being stored as data in a knowledge base means;

inferring and judging heat conditions in the blast furnace, on the basis of said true-and-false date and said data in said knowledge base means and formed by accumulated experience on the operation of the blast furnace; and controlling heat conditions in the blast furnace in accordance with results of said inferring and judging step.

DESCRIPTION OF THE PREFERRED EMBODIMENT

An embodiment according to the present invention will now be described, with reference to FIGS. 1 to 4.

Figure 1:
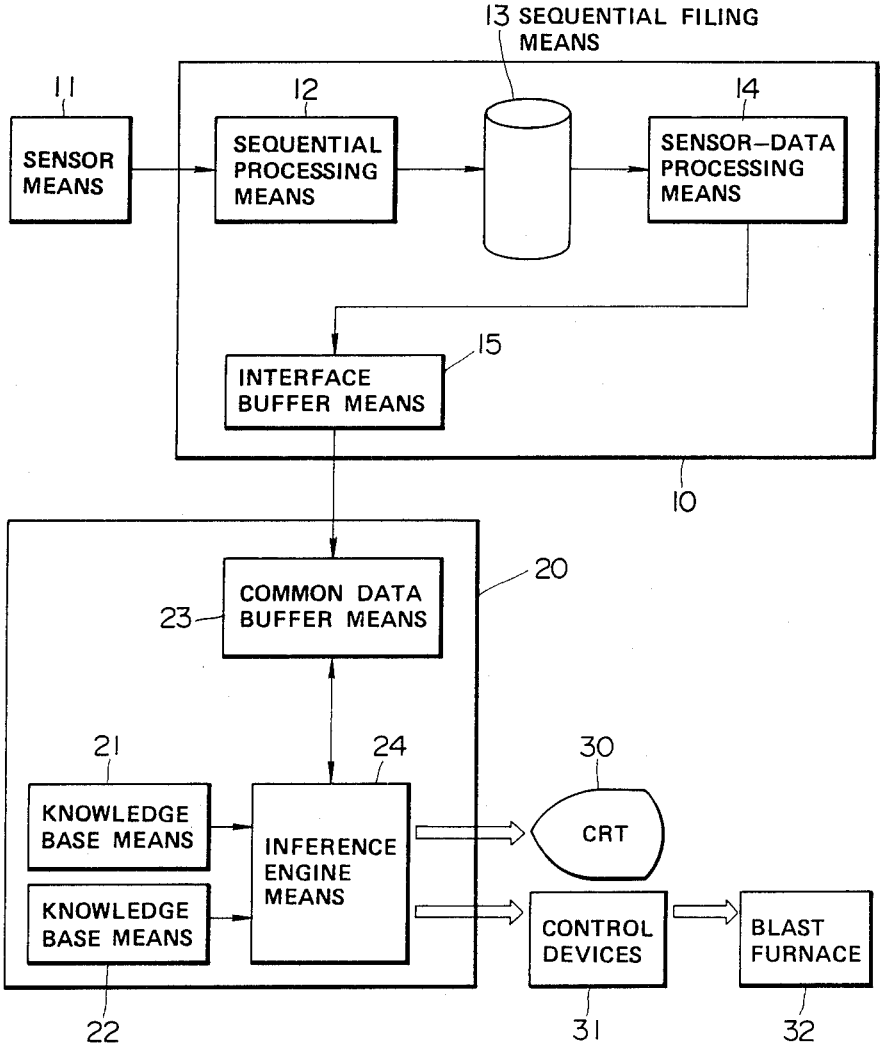
FIG. 1 is a schematic representation illustrating a method for controlling heat conditions in a blast furnace according to the present invention.

FIG. 1 schematically represents a method for controlling heat conditions in a blast furnace according to the present invention. Reference numeral 10 denotes a large-scale computer. Computer 10 includes sequential processing means 12 which processes sequentially the data outputted from sensor means 11, sequential filing means 13, sensor-data processing means 14 and interface buffer means 15. Reference numeral 20 denotes a small-scale computer, which includes knowledge base means 21 for judging heat conditions of the blast furnace, knowledge base means 22 for judging actions in response to the heat conditions, common data buffer means 23 and inference engine means 24. Reference numeral 30 denotes a cathode ray tube (CRT), which displays the results calculated by the inference engine means. Reference numeral 31 denotes control devices which control heat conditions in the blast furnace.

Figure 2:
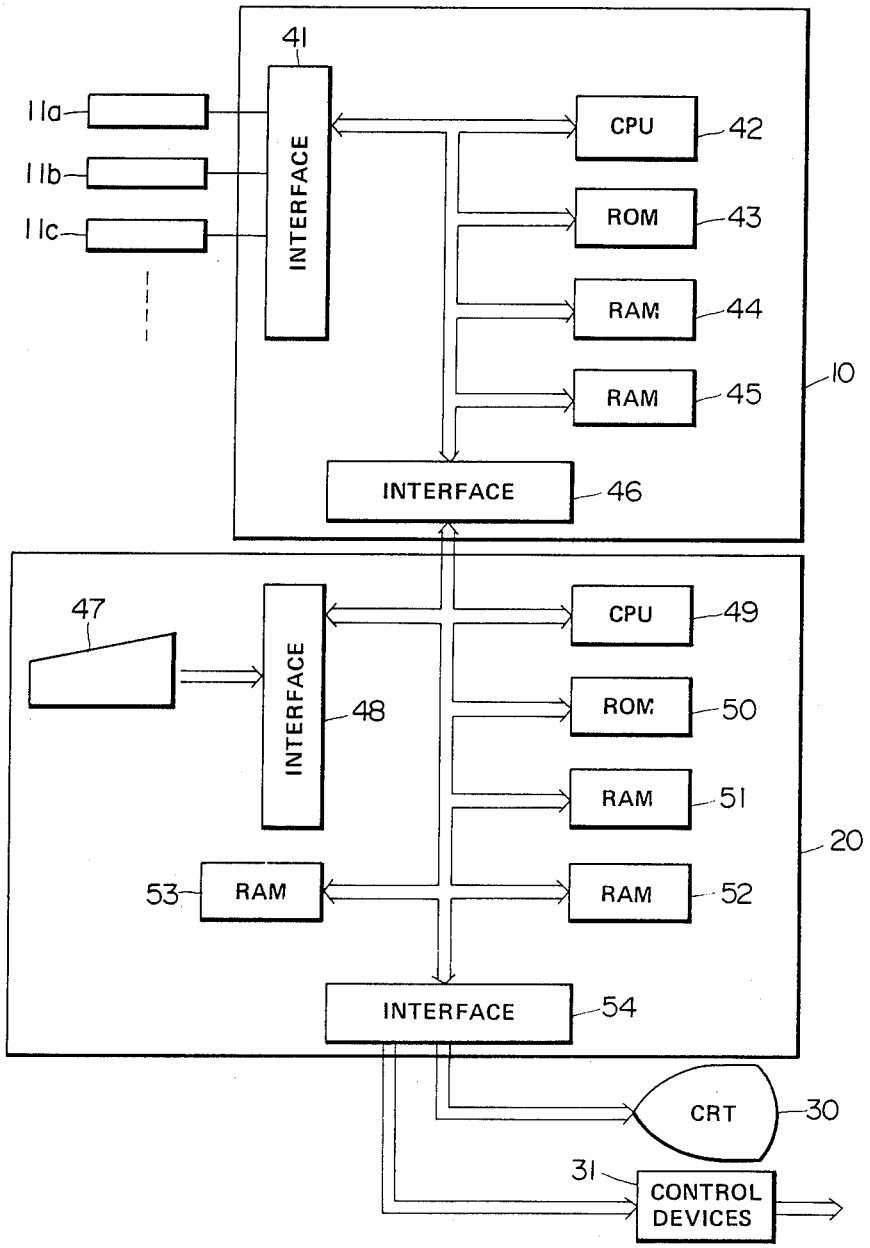
FIG. 2 is a schematic block representation showing an apparatus for performing the method of the present invention.

FIG. 2 schematically illustrates an apparatus for performing the method according to the present invention. Reference numerals 11*a*, 11*b* and 11*c* each indicate sensors corresponding to sensor means 11 shown in FIG. 1. Large-scale computer 10 includes the following devices:

41: interface

42: computer processing unit (CPU)
43: read only memory (ROM) storing program
44: and 45: random access memories (RAMs); and
46: interface CPU 42 and ROM 43, which store the programs to be executed by CPU 42, constitute sequential processing means 13 and sensor-data processing means 14, both shown in FIG. 1. RAM 44 constitutes sequential filing means 13 shown in FIG. 1. RAM 45 temporarily stores the data outputted from sensor means 11. RAM 45 and interface 46 constitute interface buffer means 15 shown in FIG. 1.

In FIG. 2, small-scale computer 20 includes key board 47, interface 48, CPU 49, ROM 50, RAMs 51 to 53 and interface 54. CPU 49 and ROM 50, which store the programs to be executed by CPU 49, constitute inference engine means 25 shown in FIG. 1. RAMs 51 and 52 constitute, respectively, knowledge base means 22 and 23 also shown in FIG. 1. RAMs 51 and 52 can be altered by operating key-board 47. New data can be added to this data by inputting the new data by means of key-board 47 via interface 48. RAM 53 constitutes common data buffer means 23 as shown in FIG. 1. The data stored in RAM 45 of large-scale computer 10 is transferred to RAM 53 via interface 46. The results obtained by CPU 49 are supplied to CRT 30, through interface 54 and are displayed.

Figure 3:
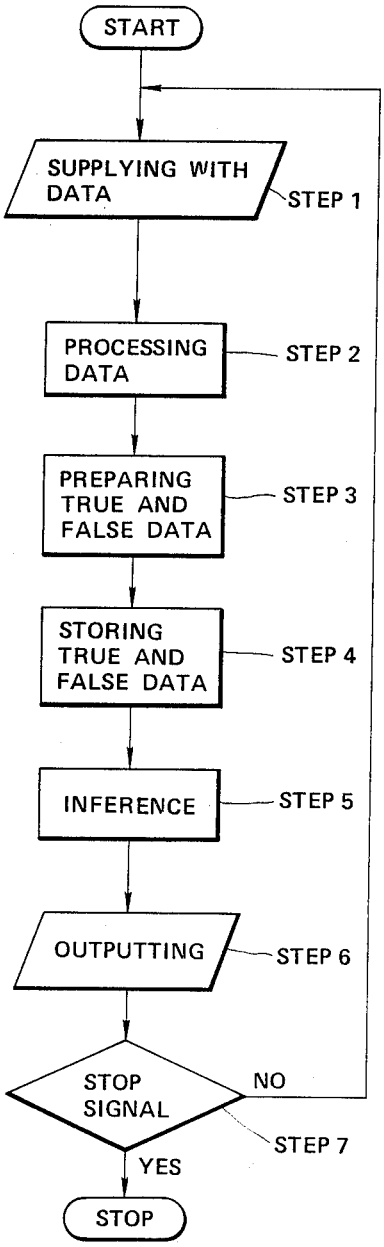
FIG. 3 is a flow diagram showing the method of the present invention.

The operation of this embodiment according to the present invention will now be described, in conjunction with the flow diagram shown in FIG. 3.

(1) Firstly, the first data outputted from sensor means 11 are read in a predetermined sequence by sequential processing means 12, and then stored in sequential filing means 13 (STEP 1). Actually, this work is completed by supplying the first data from sensors 11*a*, 11*b*, 11*c* and so forth to RAM 44, through interface 41, under the control of CPU 42.

(2) The first data stored in sequential filing means 13 are processed by CPU 42, thereby second data showing operation conditions of the blast furnace being formed. This processing step produces data showing a rate of change, comparison of levels, dispersion of values and integral values of the first data within a designated time interval. This work is actually carried out (STEP 2).

(3) The second data obtained in STEP 2 are compared with standard data, thereby providing true-and-false data. The true-and-false data are stored in interface buffer means 15. More specifically, the data are stored in RAM 45 shown in FIG. 2 (STEP 3).

(4) The true-and-false data stored in interface buffer means 15 are transferred to common data buffer means 23 (STEP 4). More precisely, the data stored in RAM 45 are transferred, through interface 46, to RAM 53.

(5) Inference engine means 24 infers heat conditions in the blast furnace, based on the data stored in knowledge base means 21 and knowledge base means 22, and on the true-and-false data stored in common data buffer means 23 (STEP 5). This work is achieved as CPU 49 executes the programs, designated by the data stored in RAMs 51 and 52, and in RAM 53.

Knowledge base means 22 is composed of knowledge units necessary for judging levels of furnace heat conditions, judging levels of transition of the furnace heat conditions, judging actions and amending the actions so as to infer efficiently. Each of those knowledge units indicates an operator's knowledge and experience on the controlling production process, in the form of "If . . . , then . . .". In this embodiment, the reliability of inference is raised by introducing to inference process a certainty factor (CF) value, which indicates the uncertainty degree of each rule for the operating production process.

Figure 4:
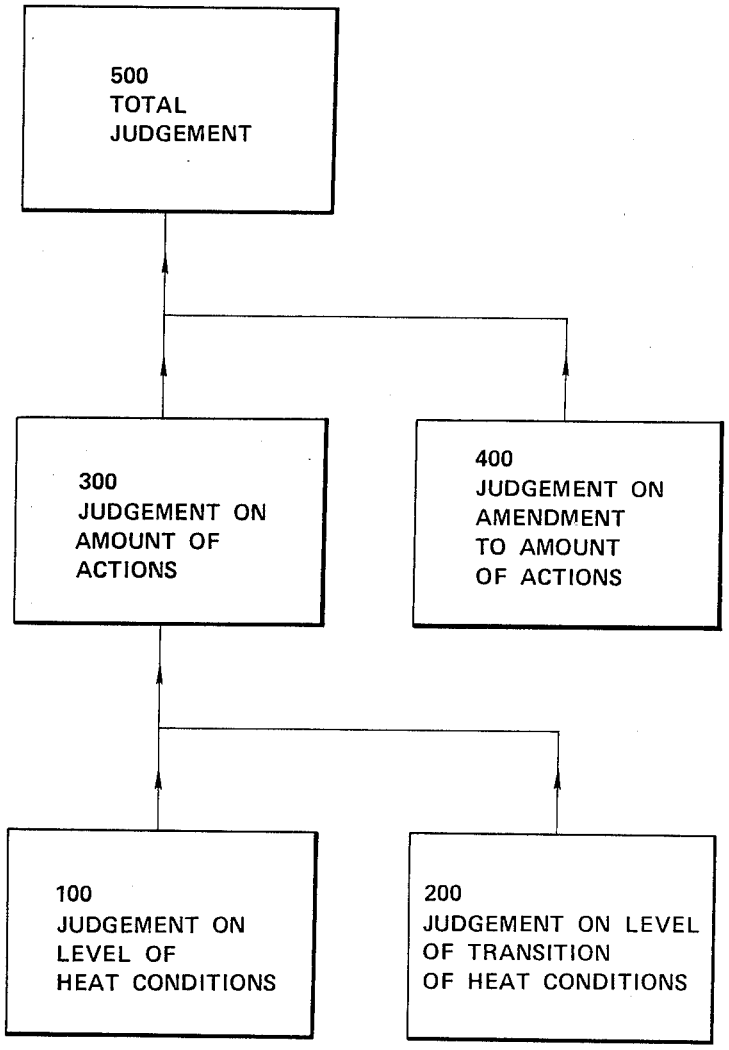
FIG. 4 is a flow diagram showing inference and judgement process according to the method of the present invention.

With reference to FIG. 4, inference engine means 24, firstly judges levels of furnace heat conditions and levels of transition of the furnace heat conditions, and then, judges amount of actions, based on the results of the preceeding judgements. Further, inference engine means 24 amends the amount of actions.

(6) Subsequently, the amount of actions amended in STEP 5 is supplied, via interface 54, to CRT 30, and is displayed. At the same time, the amended amount is transferred to control devices 31, the humidity of blast air to be blown into the blast furnace being controlled.

(7) Then, it is determined whether stop signal has been given or not. If "YES", the processing is stopped. If "NO", it returns to STEP 1 (STEP 7). In the latter case, the aforementioned STEPs 1 to 7 are repeated at predetermined intervals of, for example, 2 minutes.

Factors on Heat Conditions in Furnace

Tuyere Nose Temperature: a temperature of a thermometer buried at an end of a tuyere nose reflects heat conditions in a blast furnace. It is shown that the higher the temperature of the thermometer becomes, the higher the heat conditions becomes.

Burdern Descend Speed: If an endothermic reaction given by the formula "FeO+C=Fe+CO" proceeds, coke consumption speed becomes fast and the burden descend speed becomes fast. Consequently, the phenomenon that the burden descend speed becomes fast means a furnace heat temperature goes down.

Furnace Top Gas Temperature: If a furnace top gas temperature becomes high, the burden descend speed becomes slow and a furnace heat temperature goes up. If a furnace top gas temperature becomes low, the furnace heat temperature goes down.

Gas Utilization Ratio: The gas utilization ratio is given by the following formula:

$$\eta_{co} = \frac{CO_2}{CO + CO_2}$$

$\eta$co: Gas Utilization ratio
CO: CO concentration in top gas (%)
$CO_2$: $CO_2$ concentration in top gas (%)

As CO gas increases, $\eta$co gets lower. Lowering of value of $\eta$ indicates increase of solution loss reaction. Consequently, infurnace heat is lowered by means of the endothermic reaction.

Solution Loss Amount: At the infurnace portion of a high temperature of 1,000° C. or more, reaction called direct reduction proceeds. Seemingly, iron oxides such as FeO are reduced to Fe by C, but actually, as shown below, reactions of formulae (a) and (b) proceed simultaneously, and they result in formula (c). The formula of (b) is called solution loss reaction. The reaction of the direct reduction is an endothermic one, and the value is exceedingly high enough to show 36,350 Kcal/Kmol. This is a fatal factor lowering infurnace heat.

$$FeO(s.1)+CO(g)=Fe(s.1)+CO_2 \quad (a)$$

$$CO_2(g)+C(s)=2CO(g) \quad (b)$$

$$FeO(S.1)+C(s)=Fe(S.1)+CO(g) \quad (c)$$

When this direct reduction reaction gets active, the percentage of $N_2$ contained in furnace top gas is lowered due to the increase of CO gas. An expert engineer of blast furnace operation catches this phenomenon, based on his experience to make use of it for aid of judging furnace heat conditions. In the system of the present invention, solution loss reaction amount is computed directly from the furnace top gas constituent, blast air conditions, molten metal chemical composition as shown below, and is stored in knowledge base.

$$Slc=BG\cdot(CO+CO_2)\cdot10^{-2}\cdot(Vbd\cdot0.21.2/22.4+Vbw\cdot T\text{-}moi\cdot10^{-3}/18)-A \quad (1)$$

$$BG=79\cdot Vbd(\%N_2)/22.4 \quad (2)$$

$$Vbd=Vbw\cdot(1-22.4\cdot10^{-3}\cdot Moi/18) \quad (3)$$

$$A=Asi+Amn+Ap \quad (4)$$

$$Asi=2\cdot[\%Si]/28\cdot10\cdot12\cdot Prod/1440 \quad (5)$$

$$Amn=[\%\ Mn]/55\cdot10\cdot12\cdot Prod/1440 \quad (6)$$

$$Ap=5/2\cdot[\%P]/31\cdot10\cdot12\cdot Prod/1440 \quad (7)$$

Vbw: blast air amount [$Nm^3$/min]
Moi: moisture of blast air [g/$Nm^3$]
Tmoi: total moisture of blast air including water blown [g/$Nm^3$]
CO, $CO_2$, $N_2$: top gas constituent
Prod: amount of tapped molten metal [T/D]
[%Zi],[%Mn],[%P]: chemical composition of molten metal Air Blast Pressure: Increase of the air blast pressure indicates that the furnace heat is high, while decrease of the air blast pressure indicates that the furnace heat is low.

Si Content in Molten Metal: Si content in molten metal is correlated with molten metal temperature. If the molten metal temperature becomes high, the Si content in molten metal becomes high.

S Content in Molten Metal: S content in molten metal is reversely correlated with molten metal temperature. If the molten metal temperature becomes high, the S content in molten metal becomes low.

Slag Color: Since molten metal discharged through tap holes includes molten slag, the molten slag is separated from the molten metal by means of a skimmer. The separated molten slag is taken out by means of a steel scoop, poured into a vessel filled with water and then rapidly cooled. The color of the cooled slag becomes white-yellow when furnace heat is satisfactory and reduction of iron ores is well done, and the color turns into black due to increase of FeO concentration in the molten slag when the furnace heat is unsatisfactory and the reduction of iron ores are not well done. Accordingly, the action to be taken is judged depending on colors of the molten slag and the action is so taken.

Processing Data on Levels of Heat Conditions

Data of tuyere nose temperature, burden descent speed, air blast pressure, furnace top gas temperature, gas utilization ratio and solution loss amount, each, are supplied every minute. Data supplied every minute is hereinafter referred to as one minute data.

(a) Molten Metal Temperature: a balance between a molten metal temperature presently supplied and a standard level molten metal temperature is computed. And then, from the balance, a molten metal temperature level is computed and obtained by using molten metal temperature membership function.

(b) Tuyere Nose Temperature: a mean value is computed from one minute data of tuyere nose temperatures supplied from all the thermometers buried in the top ends of all the tuyere noses. One minute data are exponentially smoothed by using the mean value to obtain a one minute data value. A balance between a one minute data value thus presently obtained and a standard level tuyere nose temperature is computed. And then, from this balance, a tuyere nose temperature level is computed and obtained by using a tuyere nose temperature membership function.

(c) Burden Descend Speed: a mean value of one minute data of burden descend speeds is computed from one minute data supplied by sounding of probes set in four points towards periphery portions at a throat level of a blast furnace to measure burden descend speed. One minute data are exponentially smoothed by using the mean value to obtain a one minute data. A balance between a one minute data value thus obtained and a standard level burden descend speed is computed. And then, from this balance a burden descend speed level is computed and obtained by using a burden descend speed membership function.

(d) Air Blast Pressure: a mean value of one minute data of air blast pressures is computed from one minute data supplied by air blast pressure gauges to measure air blast pressures of blowers sending hot air into a blast furnace. One minute data is exponentially smoothed to obtain a one minute data value. A balance between a one minute data value thus presently obtained and a standard level air blast pressure is computed and then, from this balance an air blast pressure level is computed and obtained by using an air blast membership function.

(e) Furnace Top Gas Temperature: a one minute data value is computed from furnace top gas temperatures supplied by furnace top gas thermometers set in four points towards periphery portions at a throat level of a blast furnace, by means of an exponential smoothing treatment. A balance between a one minute data value thus presently obtained and a standard level furnace top gas temperature is computed. And then, a furnace top gas level is computed and obtained by using a furnace top gas membership function.

(f) Gas Utilization Ratio: One minute data of the gas utilization ratio is obtained from a furnace top gas constituents of CO and $CO_2$ a gas chromatography. The one minute data are exponentially smoothed to obtain a one minute data value. A balance between a one minute data value thus obtained and a standard level gas utilization ratio is computed. And then, from this balance, a gas utilization level is computed and obtained by using a gas utilization ratio membership function.

(g) Solution Loss Amount: One minute data of the solution loss amount are obtained from one minute solution loss amount data measured by a gas chromatography. The one minute data is exponentially smoothed to obtained a one minute data value. A balance between a one minute data value thus obtained and a standard level solution loss amount is computed. And then, from this balance a solution loss amount level is computed and obtained by using a solution loss amount membership function.

Judgement on levels of furnace heat conditions

Figure 5:
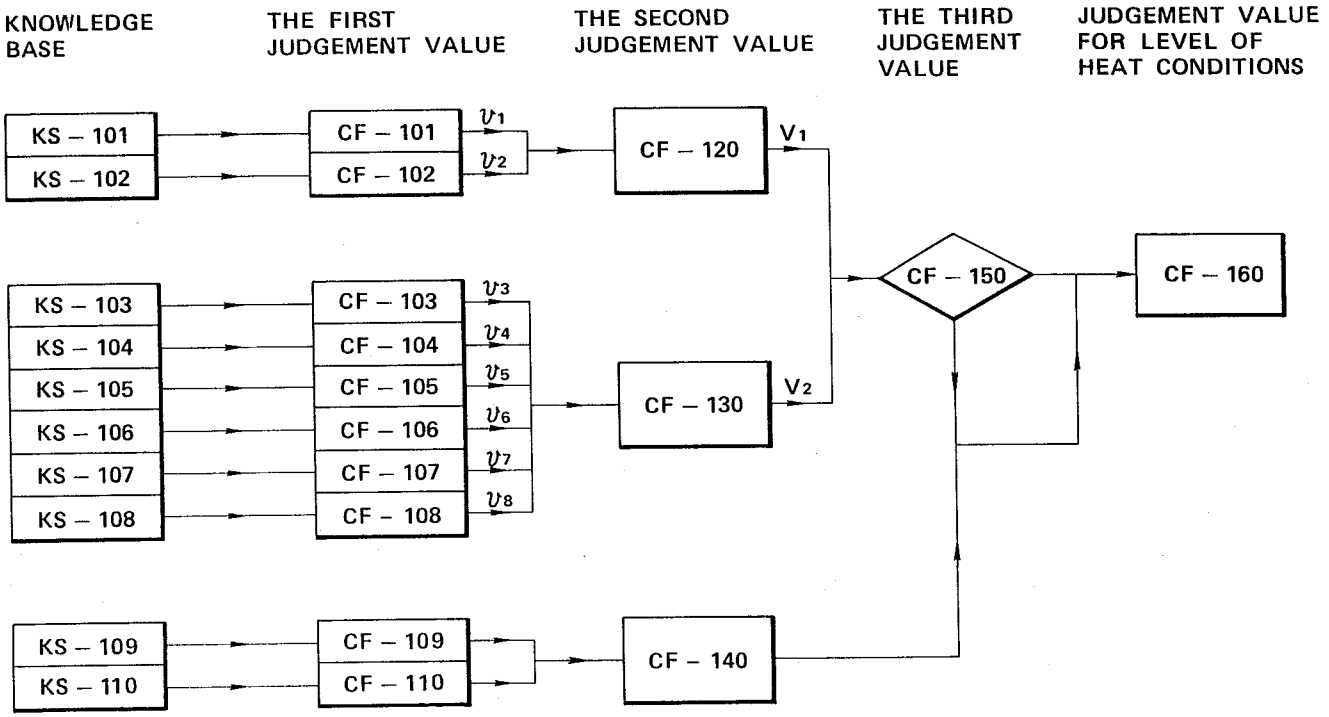
FIG. 5 is a flow representation showing a step method of judging levels of heat conditions in the blast furnace according to the present invention.

With specific reference to FIG. 5, process of judging levels of heat conditions in a blast furnace will now be explained in detail.

Knowledge units stored in knowledge base means 21 contain rules for molten metal temperature (KS-109, 110), rules for sensors (KS-103 to KS-108) and human judgement rules (KS-109, 110), as those for the controlling production process.

(a) Rules for molten metal temperature

These rules are for judging present levels of furnace heat conditions from a present molten metal temperature.

A rule for molten metal temperature, KS-101 judges furnace heat conditions, based on experiences statistically accumulated in the past operation of a blast furnace.

A rule for molten metal temperature, KS-102 judges levels of furnace heat conditions by means of estimating the highest temperature of molten metal presently tapped out. This estimation is based on statistic calculation of the latest n pieces of molten metal temperature measured.

Certainty factor (CF) values, CF-101 and CF-102, each, are obtained from rules for molten metal temperature KS-101 and KS-102, each. The rules of KS-101 and KS-102 are given weights. In this weighting, for example, $v_1$ is given to KS-101, and $v_2$ to KS-102. The sum of $v_1$ plus $v_2$ is set to be 1. A judgement value for levels of furnace heat conditions, CF-120 is obtained, consideration of the weights of $v_1$ and $v_2$, from CF-101 and CF-102.

(b) Rules for sensors

Among these rules, there are tuyere nose temperature rule 103, a burden descent speed rule 104, a furnace top gas temperature rule 105, a gas utilization ratio rule 106, a solution loss amount rule 107, and a pressure rule for air blown into a blast furnace 108. For each of rules from 103 to 108, a level of furnace heat conditions is respectively computed. The level further consists of 7 levels as hereinafter explained. Certainty factor (CF) value is computed for each of the 7 levels. Weights of $v_3$, $v_4$, $v_5$, $v_6$, $v_7$ and $v_8$ are also given to the rules, each, and the sum of $v_3$ to $v_8$ equals to 1. A judgement value for levels of furnace heat conditions, CF-130 is obtained, in consideration of the weights of $v_3$ to $v_8$, from CF-103 to CF-108.

More specifically, computation of levels of furnace heat conditions outputted from sensors will be explained.

In the case of level 7, CF value for level 7 is computed and obtained by summing each of the following:

(CF value for Level 7 of Tuyere Nose Temperature)×(Weighing on Tuyere Nose Temperature)

(CF Value for Level 7 of Burden Descend Speed)×(Weighing on Burden Descend Speed);

(CF Value for Level 7 of Air Blast Pressure)×(Weighing on Air Blast Pressure);

(CF Value for Level 7 of Furnace Top Gas)×(Weighing on Furnace Top Gas);

(CF Value for Level 7 of Gas Utilization Ratio)×(Weighing on Gas Utilization Ratio); and (CF Value for Level 7 of Solution Loss Amount)×(Weighing on Solution Loss Amount).

CF Value for each of levels 6, 5, 4, 3, 2 and 1 is also computed and obtained similarly to the case of that for level 7. As described above, a level of furnace heat conditions, based on the information outputted from sensors which is taken into consideration of a CF value corresponding to levels 7 to 1, each concerned, is computed and obtained.

(c) Two other judgement rules

These rules includes a tuyere condition rule and a slag color rule.

The tuyere condition rule inputs one selected from the items consisting of "as previously set", "obscure" "good", "ordinary" and "bad" (judgement on levels of furnace heat conditions CF-109). Similarly, the slag color rule inputs one selected from the items consisting of "as previously set", "obscure", "color" number 1 to 5: (1; good, 2; ordinary, and 3 to 5; "bad") (judgement on levels of furnace heat conditions, CF-110). A judgement on levels of furnace heat conditions, CF-140 of certainty factor values is obtained, in consideration of the levels of CF-109 and CF-110. Each of the items ranks grades 1 to 7. Consequently, the judgement on each of the levels is determined by combination of items with grades.

(d) Judgement on levels of furnace heat conditions

A certainty factor value (CF-150), as a sum of each level of furnace heat conditions, is judged from CF-120 drawn out of the rules for molten metal temperature, and from CF-130 out of the rules for sensors. In this judgement, CF-120 and CF-130 are given weights of $V_1$ and $V_2$. The sum of $V_1$ and $V_2$ equals to 1. Thus, a judgement on levels of furnace heat conditions, CF-150 of certainty factor values, is obtained, in consideration of the weights of $V_1$ and $V_2$ as shown in Table 1. In this case, the levels of furnace conditions is composed of levels of 1 to 7.

TABLE 1

| Level of Furnace Heat Conditions | Evaluation of Heat Temperature |
|---|---|
| 7 | Most Heated |
| 6 | More Heated |
| 5 | Ordinary |
| 4 | Cooled |
| 3 | More Cooled |
| 2 | Most Cooled |
| 1 | Extraordinarily Cooled |

For example, when a certainty factor value of levels of furnace conditions "1" (Extraordinarily Cooled) or "2" (Most Cooled) is a predetermined value of Wx or over, a judgement rule is applied, wherein CF value for each of levels 1 to 7 for furnace heat conditions (a judgement on levels of furnace heat conditions CF-160) is computed by summing CF-140 and CF-150.

More specifically, computation of furnace heat conditions will be explained.

In the case of level 7, the computation is carried out by summing each of the following:

(CF Value of Level 7 of Molten Metal Temperature)×(Weighing on Molten Metal Temperature); and (CF Value for Level 7 of Furnace Heat Conditions, based on Sensors)×(Weighing on Furnace Heat Conditions, based on Sensors).

In the case of level 6, the computation is carried out by summing each of the following:

(CF Value for Level 6 of Molten Metal Temperature)×(Weighing on Molten Metal Temperature); and (CF Value for Level 6 of Furnace Heat Conditions, based on Sensors)×(Weighing on Furnace Heat Conditions, based on Sensors).

CF value for each of levels 5, 4, 3, 2 and 1 is also computed and obtained similarly to those cases of levels 7 and 6. As described above, a level of furnace heat conditions having a CF value corresponding to levels 7 to 1, is computed and obtained.

For the purpose of judgement on levels of furnace heat conditions, knowledge units are classified into three categories, i.e., rules for molten metal temperature, those for sensors and those for two other judgements, by reason of the following:

1. Object of control, itself is molten metal temperature;

2. The molten metal temperature can be detected, by nature, approximately every 20th minute at best. The treatment of the information is different from that of the information outputted from sensors, since the sensors can gather information data every minute;

3. The molten metal temperature starts with low temperature, due to hearth bottom and troughs of a blast furnace being cooled, and increases gradually. Consequently, when the highest molten metal temperature in a tap, for example, is to be controlled, levels of furnace heat conditions must be judged, these additional affecting factors being taken into consideration;

4. When operation is successful, the behavior of the molten metal temperature and the work of sensors are correlated though there is time delay. But, when, for example, molten slag within the blast furnace increases in volume, thereby distribution of top gas being peripherally prevailed, the correlation between the behavior and the work becomes reverse. In this case, it is preferable to judge the levels of furnace heat conditions, separately based on rules for molten metal temperature and rules for sensors, each.

5. Other judgement rules are composed of two rules. In the case of operation being abnormal, it is recommendable to use the two rules separately. This easily enables certainty factor values for the abnormal conditions to be strengthened, and information unobtainable through sensor means to be grasped so as to decide an optimum action in response. Of course, in the case of operation being normal, automatic control is principally employed without use of other judgement.

Examples for Judgement on Levels of Furnace Heat conditions (a) Molten Metal Temperature: For example, in the case of a molten metal temperature being 1,490° to 1,500° C., the molten metal temperature level is represented as follows:

| Level | CF Value |
|---|---|
| 7 | 0.1 |
| 6 | 0.2 |
| 5 | 0.5 |
| 4 | 0.4 |
| 3 | 0.3 |

-continued

| Level | CF Value |
|---|---|
| 2 | 0.2 |
| 1 | 0.1 |

(b) Tuyrere Nose Temperature: For example, in the case of a tuyere nose temperature being 140° C. to 150° C., the tuyere nose temperature level is represented as follows:

| Level | CF Value |
|---|---|
| 7 | 0.1 |
| 6 | 0.3 |
| 5 | 0.5 |
| 4 | 0.4 |
| 3 | 0.2 |
| 2 | 0.1 |
| 1 | 0 |

(c) Burden Descend Speed: For example, in the case of a burden descend speed being 0.1 to 0.105 m/min., the burden descend speed level is represented as follows:

| Level | CF Value |
|---|---|
| 7 | 0.3 |
| 6 | 0.4 |
| 5 | 0.7 |
| 4 | 0.5 |
| 3 | 0.4 |
| 2 | 0.2 |
| 1 | 0.1 |

(d) Air Blast Pressure: For example, in the case of an air blast pressure being 3.80 to 3.805 Kg/cm$^2$, the air blast pressure is represented as follows:

| Level | CF Value |
|---|---|
| 7 | 0.3 |
| 6 | 0.4 |
| 5 | 0.7 |
| 4 | 0.6 |
| 3 | 0.4 |
| 2 | 0.2 |
| 1 | 0.1 |

(e) Furnace Top Gas Temperature: For example, in the case of a furnace top temperature being 160° C. to 170° C., the furnace top gas temperature level is represented as follows:

| Level | CF Value |
|---|---|
| 7 | 0.2 |
| 6 | 0.4 |
| 5 | 0.7 |
| 4 | 0.3 |
| 3 | 0.2 |
| 2 | 0.1 |
| 1 | 0 |

(f) Gas Utilization Ratio: For example, in the case of a gas utilization ratio being 50.0 to 50.2%, the gas utilization ratio level is represented as follows:

| Level | CF Value |
|---|---|
| 7 | 0.1 |

-continued

| Level | CF Value |
|---|---|
| 6 | 0.3 |
| 5 | 0.5 |
| 4 | 0.4 |
| 3 | 0.2 |
| 2 | 0.1 |
| 1 | 0 |

(g) Solution Loss Amount: For example, a solution loss amount being 36.0 to 37.0 Kmol/min, the solution loss amount level is represented as follows:

| Level | CF Value |
|---|---|
| 7 | 0.1 |
| 6 | 0.3 |
| 5 | 0.5 |
| 4 | 0.4 |
| 3 | 0.2 |
| 2 | 0.1 |
| 1 | 0 |

Figure 7:
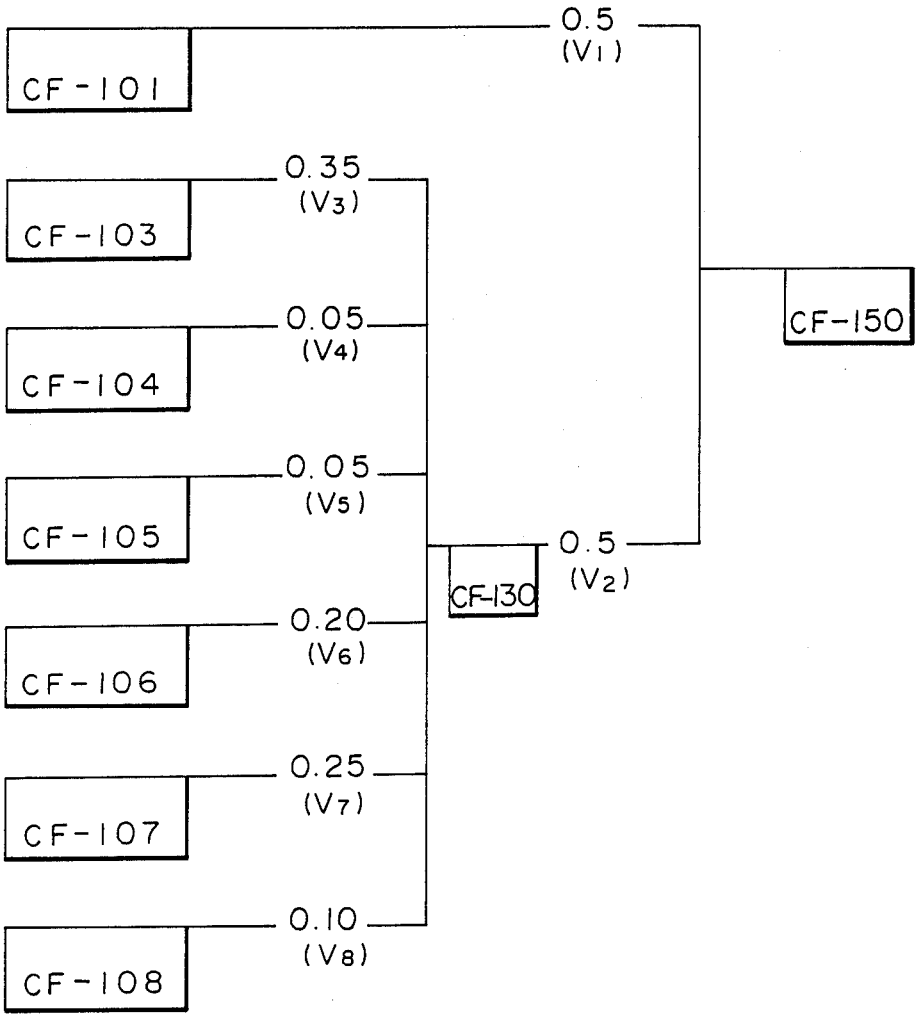
FIG. 7 is a flow representation of weighing levels of furnace heat conditions according to the present invention.

(h) Weighing on Furnace Heat Conditions: FIG. 7 of the drawings shows a flow of weighing levels of furnace heat conditions, giving an example of the weighing.

Processing of Data on Levels of Transition of Furnace Heat Conditions (a) Molten Metal Temperatures: A balance between a molten metal temperature of molten metal previously tapped and that of molten metal tapped latest is computed, and then, from the balance, a level of transition of furnace heat conditions is computed and obtained by using a molten metal temperature transition level membership function. Furthermore, from a balance between a molten metal temperature of molten metal tapped immediately before the previously tapped molten metal and a molten metal temperature of the previously tapped molten metal, a molten metal temperature level is computed and obtained by using a molten metal transition level membership function.

(b) Tuyere Nose Temperature: A balance between a one minute data value of a tuyere nose temperature obtained at a present moment and that obtained 60 minutes before the present moment measurement. From this balance, a tuyere nose temperature transition level is computed and obtained by using a tuyere nose temperature transition membership function.

(c) Burden Descend Speed: From a balance between a one minute data value of a burden descend speed obtained at a present moment and that obtained 60 minutes before the present moment measurement a burden descend speed transition level is computed and obtained by using a burden descend transition membership function.

(d) Air Blast Pressure: From a balance between a one minute data value of an air blast pressure obtained at a present moment and that obtained 60 minutes before the present moment measurement, an air blast pressure transition level is computed and obtained by using an air blast pressure transition membership function.

(e) Furnace Top Gas Temperature: From a balance between a one minute data value of a furnace top gas temperature obtained at a present moment and that obtained 60 minutes before the present moment measurement, a furnace top gas temperature transition level is computed and obtained by using a furnace top gas temperature transition membership function.

(f) Gas Utilization Ratio: From a balance between a one minute data value of a gas utilization ratio obtained at a present moment and that obtained 60 minutes before the present moment measurement, a gas utilization ratio transition level is computed and obtained by using gas utilization ratio transition membership function.

(h) Solution Loss Amount: From a balance between a one minute data value of a solution loss amount obtained at a present moment and that obtained 60 minutes before the present moment measurement, a solution amount transition.

(h) Si Content in Molten Metal: From a balance between a Si content value in molten metal of the previous tap and that in molten metal of the latest tap, a transition level of a Si content value in molten metal is computed and obtained by using transition level membership function of a Si content value in molten metal.

(i) S Content in Molten Metal: From a balance between a S content in molten metal of the previous tap and that in molten metal of the latest tap, a transition level of a S content in molten metal is computed and obtained by using transition level membership function of a S content value in molten metal.

Judgement on Levels of Transition of Furnace Heat Conditions

Figure 6:
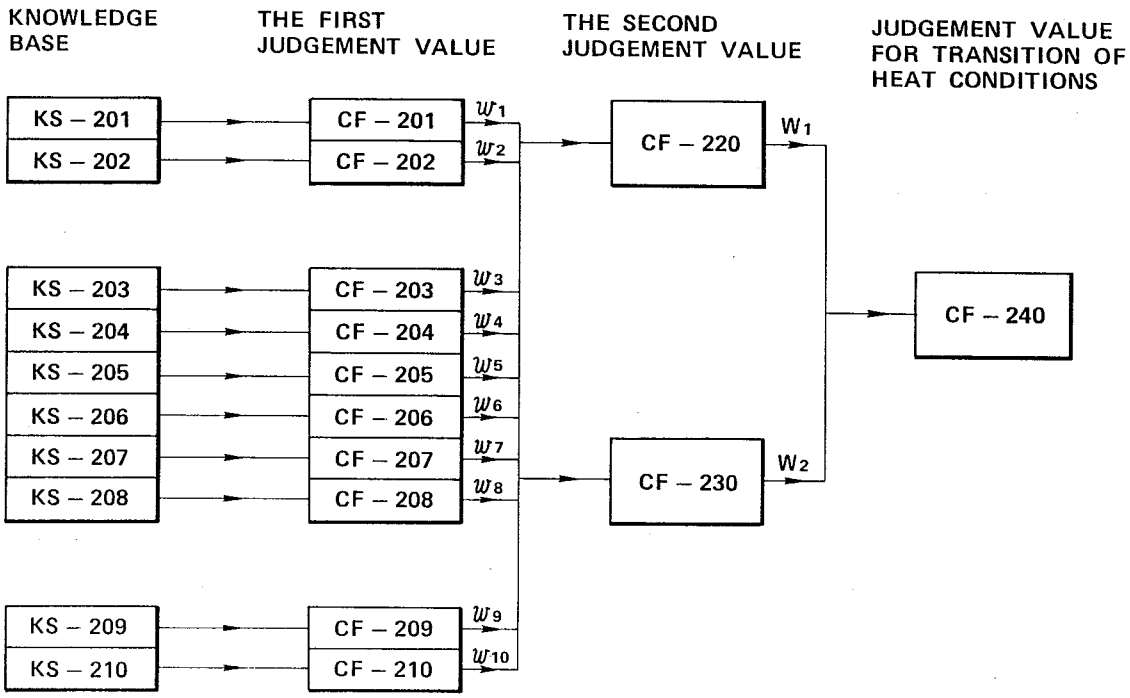
FIG. 6 is a flow representation showing a step method of judging levels of transition of heat conditions in the blast furnace according to the present invention.

As shown in FIG. 6, for judgement on levels of transition of heat conditions in the blast furnace, knowledge units stored in knowledge base means 22 contain rules for molten metal temperature (KS-201, -202), rules for sensors (KS-203 to KS-208) and the other rules (KS-209, 210), as those for the controlling production process. For each of those rules, certainty factor (CF) values of levels of C1 to C5 as shown in Table 3 is computed.

TABLE 3

| Levels of Transition of Furnace Heat Conditions | Evaluation |
|---|---|
| C5 | Considerable Increase |
| C4 | Increase Tendency |
| C3 | No Change |
| C2 | Decrease Tendency |
| C1 | Considerable Decrease |

(a) Rules for molten metal temperature

These rules for molten metal temperature are a rule for comparison of the latest temperature of molten metal with the highest molten metal temperature in a previous tap (KS-201), and a rule for comparison of the highest molten metal temperature in a previous tap with the highest molten metal temperature in a tap immediately before the previous tap.

More specifically, computation of levels of transition of furnace heat conditions, based on molten metal temperature will be explained.

CF value for level 5 is computed and obtained by summing each of the following:

{CF Value for Level 5 of Molten Metal Temperature Transition (1), based on a Balance between Molten Metal Temperatures of Present Tap (1) and Previous Tap}×{Weighing on Molten Metal Temperature Transition (1)}; and {CF Value for Level 5 of Molten Metal Temperature Transition (2), based on a Balance between Molten Metal Temperatures of Previous Tap and Tap before Previous Tap}×{Weighing on Molten Metal Temperature Transition (2)}.

As described above, a level of furnace heat conditions, based on molten metal temperatures, having a CF value corresponding to levels 5 to 1, is computed and obtained.

(b) Rules for sensors

Among these rules, there are a tuyere nose temperature rule, a burden descent speed rule, an air blast rule, a gas utilization rule, a solution loss amount rule and a furnace top gas temperature rule. From each of the rule, CF values (CF-203 to CF-208), each, are computed and obtained. The CF values rank five levels.

(c) The other rules

The other rules are a rule for transition of contents of silicon and sulfur (KS-209) and a rule for index of furnace conditions (KS-210). CF values (CF-209, -210), each, are computed for the rules.

(d) Judgement on levels of transition of furnace heat conditions

In the case of the rules for molten metal temperature, the rules of KS-201 and KS-202 are given, respectively, weights of $W_1$ and $W_2$. The sum of the weights equals to 1. A judgement on levels of transition of heat conditions in the blast furnace, CF-220 is obtained, in consideration of the weights, from CF-201 and CF-202.

Similarly, the rules of KS-203 to KS-210 are given, respectively, weights of $w_3$, $w_4$, $w_5$, $w_6$, $w_7$, $w_8$, $w_9$ and $w_{10}$, and the sum of the weights of $w_3$ to $w_{10}$ is 1. A judgement on levels of transition of heat conditions in the blast furnace, CF-230 is obtained, in consideration of the weights, from CF-203 to CF-210.

And then, a CF value (CF-240) of levels of transition of heat conditions in the blast furnace for each of five levels, is obtained by summing CF values of CF-220 and CF-230.

More specifically, computation of levels of transition of furnace heat conditions will be explained.

Levels of transition of furnace heat conditions are computed and obtained from a transition level of furnace heat conditions, based on molten metal temperatures, a transition level of furnace heat conditions, based on sensors and a transition level of furnace heat conditions based on compositions of molten metal.

For example, a level 5 is computed and obtained by summing each of the following:

(CF Value for Level 5 of Transition Level of Furnace Heat Conditions, based on Molten Metal Temperatures)×(Weighing on Transition of Furnace Heat Conditions based on Molten Metal Temperatures);

(CF Value for Level 5 of Transition of Furnace Heat Conditions, based on Sensors)×(Weighing on Transition of Furnace Heat Conditions, based on Sensors); and (CF Value for Level 5 of Transition of Furnace Heat Conditions, based on Sensors)×(Weighing on Transition of Heat Conditions, based on Sensors).

CF value for each of levels 4 to 1 is also computed and obtained similarly to the case of level 5. As described above, a level of transition of furnace heat conditions having CF value corresponding to levels 5 to 1, is computed and obtained.

Examples for Judgement on Levels of Transition of Furnace Heat Conditions (a) Molten Metal Temperature: For example, in the case of a molten metal temperature at a present moment being by 30° C. lower than that of the previous tap, the molten metal temperature transition level is represented as follows:

| Level | CF Value |
|---|---|
| 5 | 0 |
| 4 | 0.1 |
| 3 | 0.15 |
| 2 | 0.3 |
| 1 | 0.6 |

(b) Tuyere Nose Temperature: For example, in the case of a tuyere nose temperature transition being −0.15° to −0.10° C./min., the tuyere nose temperature transition level is represented as follows:

| Level | CF Value |
|---|---|
| 5 | 0.1 |
| 4 | 0.2 |
| 3 | 0.3 |
| 2 | 0.4 |
| 1 | 0.5 |

(c) Burden Descent Speed: For example, in the case of a burden descent speed transition being 0.0005 to 0.001 m/min./min., the burden descent speed transition level is represented as follows:

| Level | CF Value |
|---|---|
| 5 | 0.1 |
| 4 | 0.2 |
| 3 | 0.3 |
| 2 | 0.4 |
| 1 | 0.5 |

(d) Air Blast Pressure For example, in the case of an air blast pressure transition being 0.0005 to 0.001 $kg/cm^2/min.$, the air blast pressure level is represented as follows:

| Level | CF Value |
|---|---|
| 5 | 0.5 |
| 4 | 0.4 |
| 3 | 0.3 |
| 2 | 0.2 |
| 1 | 0.1 |

(e) Furnance Top Gas Temperature: For example, in the case of a furnace top gas temperature transition being 1° to 2° C./min., the furnace top gas temperature level is represented as follows:

| Level | CF Value |
|---|---|
| 5 | 0.5 |
| 4 | 0.4 |
| 3 | 0.3 |
| 2 | 0.2 |
| 1 | 0.1 |

(f) Gas Utilization Ratio: For example, in the case of a gas utilization ratio transition being −0.015 to −0.10%/min., the gas utilization ratio transition level is represented as follows:

| Level | CF Value |
|---|---|
| 5 | 0.1 |
| 4 | 0.2 |
| 3 | 0.3 |
| 2 | 0.4 |
| 1 | 0.5 |

(g) Solution Loss Amount: For example, in the case of a solution loss amount transition being 0.2 to 0.25 Kmol/min., the solution loss amount transition level is represented as follows:

| Level | CF Value |
|---|---|
| 5 | 0.1 |
| 4 | 0.2 |
| 3 | 0.3 |
| 2 | 0.4 |
| 1 | 0.5 |

(h) Si content in Molten Metal: For example, in the case of a Si content in molten metal of the latest tap being reduced 0.15 to 0.2% from that in molten metal of the previous tap, the transition level of a Si content in molten metal is represented as follows:

| Level | CF Value |
|---|---|
| 5 | 0 |
| 4 | 0.1 |
| 3 | 0.15 |
| 2 | 0.3 |
| 1 | 0.6 |

(i) S Content in Molten Metal: For example, in the case of a S content in molten metal of the latest tap being reduced by 0.015 to 0.02% from that in molten metal of the previous tap, the transition level of a S content is represented as follows:

| Level | CF Value |
|---|---|
| 5 | 0 |
| 4 | 0.1 |
| 3 | 0.15 |
| 2 | 0.3 |
| 1 | 0.6 |

Figure 8:
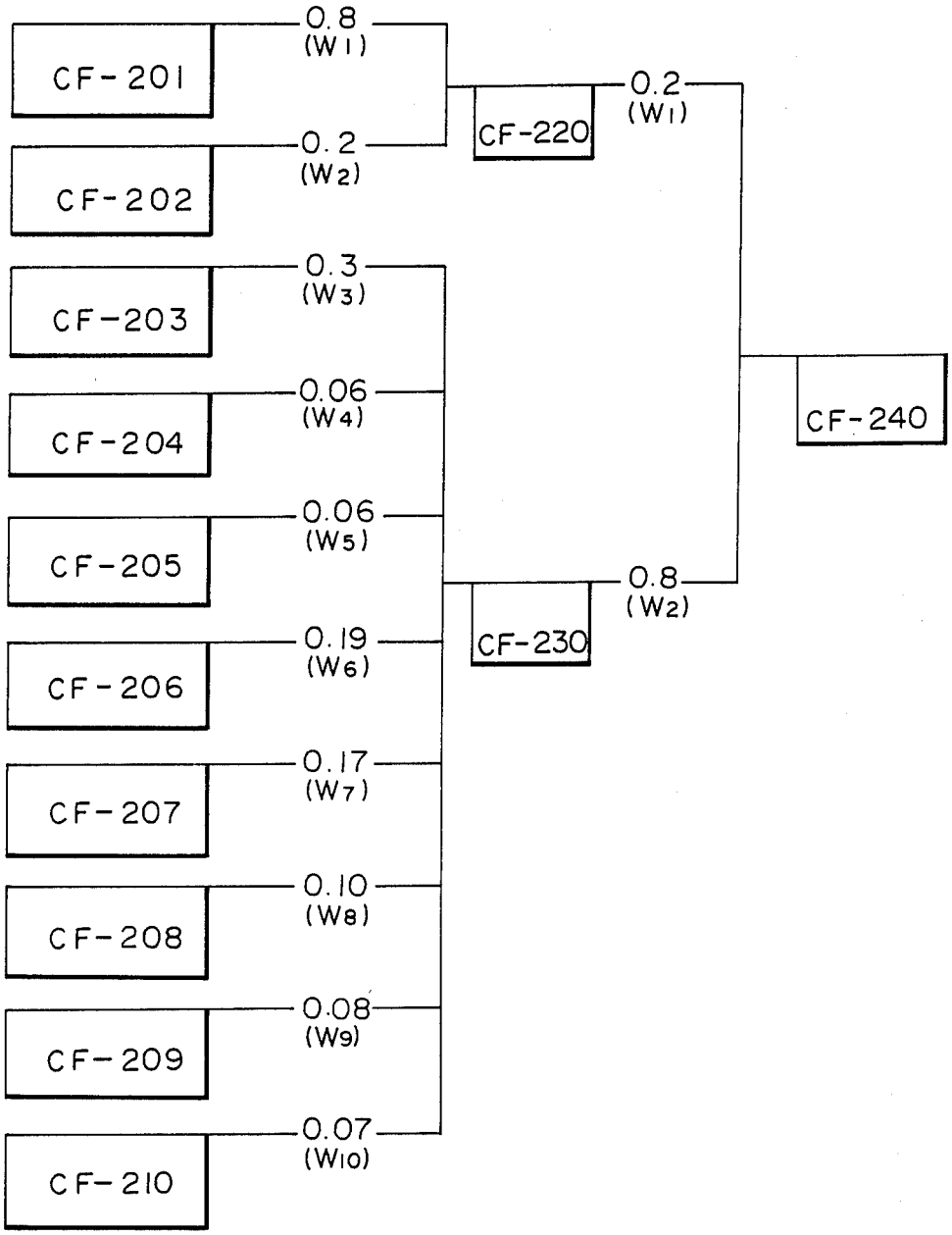
FIG. 8 is a flow representation of weighing levels of transition of furnace heat conditions.

(j) Weighing on Levels of Transition of Furnace Heat Conditions: FIG. 8 of the drawing shows a flow of weighing levels of transition of furnace heat conditions, giving an example of the weighing.

Judgement on actions

Based on CF values for levels of furnace heat conditions (L1 to L7) and for levels of transition of furnace heat conditions ($C_1$ to $C_5$) obtained in such a manner as described in the above, amount of actions is judged as shown in Table 4.

TABLE 4

| | | Grade (j) | | | | |
|---|---|---|---|---|---|---|
| | | Levels of Transition of Furnace Heat Conditions | | | | |
| Grade (i) | | 5 | 4 | 3 | 2 | 1 |
| | 7 | $a_{75}$ | $a_{74}$ | $a_{73}$ | $a_{72}$ | $a_{71}$ |

TABLE 4-continued

| | | Grade (j) | | | | |
|---|---|---|---|---|---|---|
| | | Levels of Transition of Furnace Heat Conditions | | | | |
| Grade (i) | | 5 | 4 | 3 | 2 | 1 |
| Level | 6 | $a_{65}$ | $a_{64}$ | $a_{63}$ | $a_{62}$ | $a_{61}$ |
| of | 5 | $a_{55}$ | $a_{54}$ | $a_{53}$ | $a_{52}$ | $a_{51}$ |
| Furnace | 4 | $a_{45}$ | $a_{44}$ | $a_{43}$ | $a_{42}$ | $a_{41}$ |
| Heat | 3 | $a_{35}$ | $a_{34}$ | $a_{33}$ | $a_{32}$ | $a_{31}$ |
| Conditions | 2 | $a_{25}$ | $a_{24}$ | $a_{23}$ | $a_{22}$ | $a_{21}$ |
| | 1 | $a_{15}$ | $a_{14}$ | $a_{13}$ | $a_{12}$ | $a_{11}$ |

A CF value represented by "$a_{ij}$" is given by the following formula:

$a_{ij}$=CF value for grade i of Furnace Heat Conditions × CF value for grade j of Transition of furnace Heat Conditions "$a_{ij}$" thus obtained corresponds to amount of actions shown in Table 5.

TABLE 5

| | |
|---|---|
| A | Moisture of air blast to be increased by 5 gr/Nm$^3$ |
| B | Moisture of air blast to be increased by 3 gr/Nm$^3$ |
| C | no action |
| D | Moisture of air blast to be decreased by 3 gr/Nm$^3$ |
| E | Moisture of air blast to be decreased by 5 gr/Nm$^3$ |
| F | Moisture of air blast to be decreased by 5 gr/Nm$^3$, and blast temperature to be increased |
| G | Amount of blast air to be decreased, and coke ratio to be increased |

CF values for amount of actions shown in Table 4 are obtained by the aforementioned formula. However, if each CF value for levels of furnace heat conditions, or for levels of transition of furnace heat conditions is less than a predetermined value, it is desirable to count such a CF value as zero. In addition, if a CF value for amount of actions shown in Table 4 is more than a predetermined value, it is recommendable that amount of actions is outputted so as to make CF values in order of numbers small to large for operation guide. And, if the same action is outputted in plurality, it is recommendable that the largest CF value is to be displayed to an operator.

More specifically, judgement on action will be explained.

If, for example, CF value for a level of furnace heat conditions and CF value for a level of transition of furnace heat conditions are determined, as shown in Table below judgement on action amount is judged.

| | | | CF Values for Levels of Transition of Furnace Heat Conditions | | | | |
|---|---|---|---|---|---|---|---|
| | | | 5 | 4 | 3 | 2 | 1 |
| | | | 0.2 | 0.3 | 0.5 | 0.2 | 0.1 |
| | 7 | 0.3 | 0.06 | 0.09 | 0.15 | 0.06 | 0.03 |
| CF Values | 6 | 0.5 | 0.10 | 0.15 | 0.25 | 0.10 | 0.05 |
| for Levels | 5 | 0.7 | 0.14 | 0.21 | 0.35 | 0.14 | 0.07 |
| of Furnace | 4 | 0.4 | 0.08 | 0.12 | 0.20 | 0.08 | 0.04 |
| Heat | 3 | 0.3 | 0.06 | 0.09 | 0.15 | 0.06 | 0.03 |
| Conditions | 2 | 0.2 | 0.04 | 0.06 | 0.10 | 0.04 | 0.02 |
| | 1 | 0.1 | 0.02 | 0.03 | 0.05 | 0.02 | 0.01 |

Amendment to amount of actions

An action amount, based on judgement on action; is amended when an effect to sensors or furnace heat conditions by an action already taken, or an additional affecting factor still remains. As such an additional affecting factor, drop of unreduced ore and sudden change of coke moisture are considered.

Action amount is correction amount necessary to obtain desirable furnace heat conditions, and is arranged, i.e., increased or decreased, by at least one selected from the following:

(a) arrangement of moisture amount contained in blast air which is blown in through a tuyere;
(b) arrangement of water amount contained in blast air which is blown in through a tuyere;
(c) arrangement of temperature of blast air which is blown in through a tuyere;
(d) arrangement of tar amount which is blown in through a tuyere;
(e) arrangement of heavy oil which is blown in through a tuyere;
(f) arrangement of blast air which is blown in through a tuyere; and
(g) arrangement of coke amount which is charged through a top of a blast furnace.

Action is taken subject to a preferential order at present practice, increase or decrease of moisture contained in blast air is ranked as the first order. Therefore, the amount of the action is expressed in terms of amount of moisture contained in blast air being blown in. When action is taken as means other than the increase or decrease of moisture, the amount of the action is converted into an amount of moisture which is increased or decreased.

According to the present invention, true-and-false data are prepared on the basis of the data outputted from sensor means 11 provided for a blast furnace, and then, inference, as an artificial intelligence, is carried out in comparison of the true-and-false data with knowledge base formed by accumulated experiences on the operation of the blast furnace. This gives advantages in that, (a) experience on the past operation can be made full use of, (b) a small capacity of computer processing units can be used, and (c) response to the changes the blast furnace undergoes during its life can easily be attained.

Example

Control of heat conditions was carried out for 20 days, employing a blast furnace with 4664 $m^3$ inner volume, according to a method of the present invention. Judgements on furnace heat conditions were made every 20th minute and actions were instructed, based on the results of the judgements.

Figure 9:
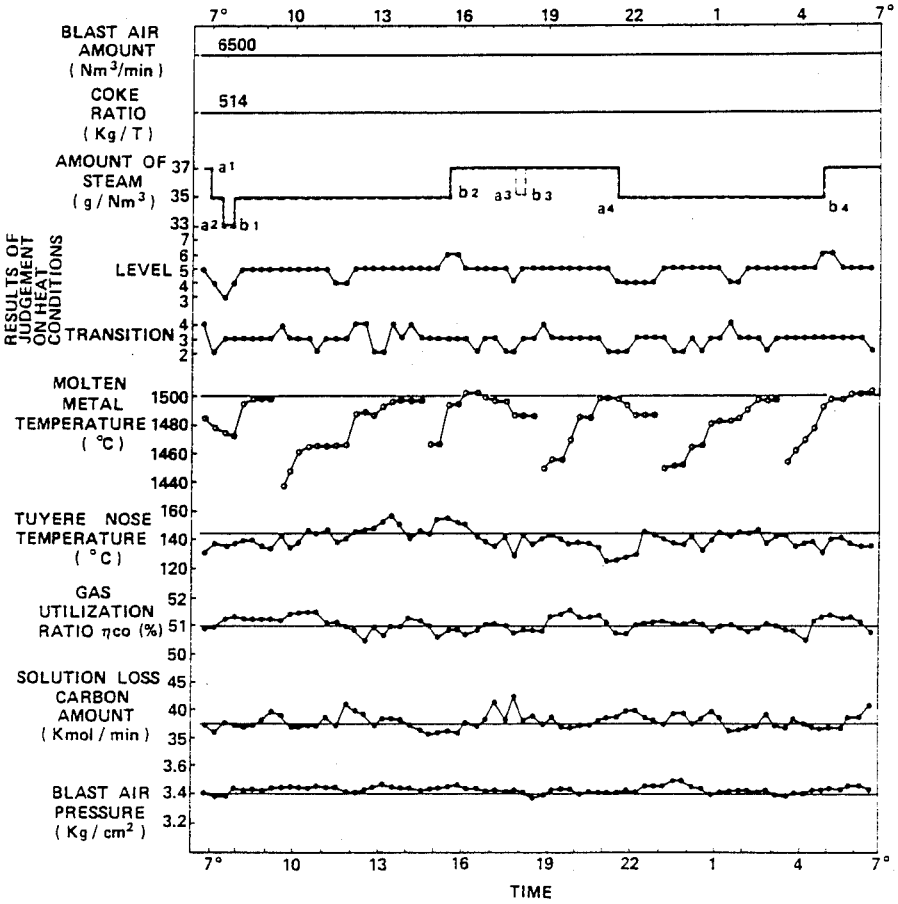
FIG. 9 is a graphic representation showing an example of the results of the blast furnace operation according to the present invention.

An example of the above operation results is shown in FIG. 9.

The operation of the blast furnace was carried out with air blast of 6,500 $Nm^3$/min. and at a coke ratio of 514 kg/T-pig. Changes of typical data outputted from the sensor means, the results of judgement on levels of furnace heat conditions and the results of judgement on transition of levels of furnace conditions are illustrated in FIG. 9.

Operational action in response to furnace heat conditions was carried out by means of controlling amount of steam. The amount of steam represented by a broken line is in compliance with instructions obtained from judgements on actions, and that of steam by a solid line, in compliance with actual actions.

Actions of increasing amount of steam ($a_1$, $a_2$, $a_3$ and $a_4$), and actions of decreasing amount of steam ($b_1$, $b_2$, $b_3$ and $b_4$) were instructed, in accordance with judgements on actions. Actions of $a_1$, $a_2$, $a_4$, $b_1$, $b_2$ and $b_4$ were actually taken.

The highest molten metal temperature representing a tap, was approximately 1500° C. The dispersion of molten metal temperatures was reduced from 9.16° C. to 6.24° C. by application of the present invention to control of furnace heat conditions. The range (maximum value minus minimum value) of molten metal temperatures was also reduced from 24.2° C. to 14.3° C.

What is claimed is:

1. A method for controlling operation of a blast furnace, wherein the blast furnace includes a sensor means which outputs first data, corresponding to conditions in said blast furnace which comprises the steps of:

supplying a central processing unit with said first data outputted from said sensor means;

storing standard data corresponding to predetermined values of data corresponding to said conditions in said blast furnace;

preparing true-and-false data by comparing said first data with said standard data;

storing information on operation and control characteristics of said blast furnace based on accumulated actual knowledge and experience of at least one operator of said blast furnace, said information being stored as data in a knowledge base means;

inferring and judging heat conditions in said blast furnace, on the basis of said true-and-false data and said data in said knowledge base means and formed by accumulated experience on the operation of the blast furnace; and controlling heat conditions in the blast furnace in accordance with results of said inferring and judging step.

2. The method according to claim 1, wherein said step of inferring and judging heat conditions in the blast furnace includes inferring and judging levels of heat conditions in the blast furnace.

3. A method according to claim 2, wherein said step of inferring and judging levels of heat conditions includes inferring and judging levels of heat conditions, from molten metal temperature.

4. The method according to claim 2, wherein said step of inferring and judging levels of heat conditions includes inferring and judging levels of heat conditions, based on data outputted from the sensor means provided for the blast furnace.

5. The method according to claim 2, wherein said step of inferring and judging levels of heat conditions includes inferring and judging levels of heat conditions, based on tuyere condition and slag color.

6. The method according to claim 4, wherein said inferring and judging, based on data outputted from the sensor means includes inferring and judging, based on at least one selected from the group consisting of:

(a) data representing tuyere nose temperature;
(b) data representing burden descent speed;
(c) data representing air blast pressure blown into the blast furnace;
(d) data representing gas utilization ratio;
(e) data representing solution loss amount pressure; and
(f) data representing furnace top gas temperature.

7. The method according to claim 1, wherein said step of inferring and judging heat conditions in the blast furnace includes inferring and judging levels of transition of heat conditions in the blast furnace.

8. The method according to claim 7, wherein said step of inferring and judging levels of transition of heat conditions includes inferring and judging levels of transition of heat conditions, from molten metal temperature.

9. The method according to claim 7, wherein said step of inferring and judging levels of transition of heat conditions includes inferring and judging levels of transition of heat conditions, based on data outputted from the sensor means provided for the blast furnace.

10. The method according to claim 7, wherein said step of inferring and judging levels of transition of heat conditions includes inferring and judging levels of transition of heat conditions, based on Si and S content in the molten metal.

11. The method according to claim 9, wherein said inference and judgement, based on data outputted from the sensor means includes inferring and judging, based on at least one selected from the group consisting of:

(a) data representing tuyere nose temperature;

(b) data representing burden descent speed;

(c) data representing air blast pressure blown into the blast furnace;

(d) data representing gas utilization ratio;

(e) data representing solution loss amount pressure; and (f) data representing furnace top gas temperature.

12. The method according to claim 1, wherein said step of inferring and judging heat conditions in the blast furnace includes inferring and judging levels of heat conditions, and inferring and judging levels of transition of heat conditions.

13. The method according to claim 1, which further comprises processing data outputted from the sensor means.

14. The method according to claim 1, wherein said step of inferring and judging heat conditions in the blast furnace includes computing certainty factor values.

15. The method according to claim 1, wherein said step of controlling heat conditions in the blast furnace operation includes judging action amount from the results of judgement on level of furnace heat conditions and from the results of judgement on transition of furnace heat conditions.

16. The method according to claim 15, wherein said action amount includes being amended, in consideration of effect by an action already taken and an additional affecting factor.

* * * * *